US009500396B2

(12) United States Patent
Yoon et al.

(10) Patent No.: US 9,500,396 B2
(45) Date of Patent: Nov. 22, 2016

(54) OIL SEPARATOR AND AIR CONDITIONER USING THE SAME

(71) Applicant: LG ELECTRONICS INC., Seoul (KR)

(72) Inventors: Pilhyun Yoon, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 171 days.

(21) Appl. No.: 13/975,637

(22) Filed: Aug. 26, 2013

(65) Prior Publication Data

US 2014/0130539 A1 May 15, 2014

(30) Foreign Application Priority Data

Nov. 12, 2012 (KR) ..... 10-2012-0127315

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2500/16* (2013.01); *F25B 2600/2515* (2013.01)

(58) Field of Classification Search
CPC ..... F25B 43/02; F25B 1/00; F25B 29/00; F25B 31/004; F25B 2600/2515; F25B 2500/16
See application file for complete search history.

(56) References Cited

U.S. PATENT DOCUMENTS 2,466,863 A * 4/1949 Phillips ..... F25B 5/02 62/472
2,665,557 A * 1/1954 Dodson ..... F25B 43/02 62/193
5,879,422 A * 3/1999 Bröttgårdh ..... B01D 19/0057 55/325
2008/0236189 A1* 10/2008 Honda et al. ..... 62/468
2010/0126211 A1* 5/2010 Okamoto ..... F25B 31/004 62/470

FOREIGN PATENT DOCUMENTS

CN 1888747 1/2007
CN 101165412 4/2008
(Continued)

OTHER PUBLICATIONS

European Search Report issued in Appln No. 13191751.0-1602 dated Feb. 21, 2014.
Chinese Search Report dated Jun. 5, 2015.

*Primary Examiner* — Emmanuel Duke
(74) *Attorney, Agent, or Firm* — Ked & Associates LLP

(57) ABSTRACT

An oil separator and an air conditioner using the same are provided. The air conditioner may include at least one indoor unit connected to an outdoor unit by a refrigerant tube. The outdoor unit may include a compressor and an oil separator including a plurality of oil recovery tubes introducing oil into the compressor. The oil separator may include a housing, a suction tube guiding oil-mixed refrigerant into the housing, a discharge tube discharging refrigerant separated from the oil-mixed refrigerant, and first and second recovery tubes discharging oil separated from the oil-mixed refrigerant. At least one of the first or second recovery tubes may include an oil valve guiding a movement direction of the oil.

5 Claims, 7 Drawing Sheets

(56) References Cited

FOREIGN PATENT DOCUMENTS

| | | | | | |
|---|---|---|---|---|---|
| EP | 1 443 286 | A1 | | 8/2004 | |
| EP | 1 659 351 | A2 | | 5/2006 | |
| EP | 1 909 048 | A1 | | 4/2008 | |
| JP | S 6458970 | A | | 3/1989 | |
| JP | 05264110 | | * | 10/1993 | ..... F25B 1/00 |
| JP | 08-005167 | | | 1/1996 | |
| JP | 8005167 | A | * | 1/1996 | ..... F25B 2700/2105 |
| JP | 08005167 | A | * | 1/1996 | |
| JP | 2012-145251 | | | 8/2012 | |
| KR | 1020047004701 | | * | 3/2004 | ..... F25B 1/00 |

* cited by examiner

OIL SEPARATOR AND AIR CONDITIONER USING THE SAME

CROSS-REFERENCE TO RELATED APPLICATION(S)

This application claims priority under 35 U.S.C. §119 to Korean Application No. 10-2012-0127315 filed on Nov. 12, 2012, whose entire disclosure is hereby incorporated by reference.

BACKGROUND

1. Field

This relates to an oil separator and an air conditioner using the same.

2. Background

Air conditioners discharge air into an inner space to adjust an indoor temperature and promote a pleasant indoor environment. Air conditioners may also have an air cleaning function for purifying indoor air. Such an air conditioner may include at least one indoor unit installed in a corresponding at least one indoor space connected to an outdoor unit including a plurality of components such as a compressor and a heat exchanger to supply refrigerant to the at least one indoor unit. The air conditioner may operate in a cooling or heating mode by supplying the refrigerant to the at least one indoor unit according to an operation state required by a user. That is, the air conditioner may perform the cooling operation or the heating operation according to a flow of the refrigerant.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. In the following detailed description, reference is made to the accompanying drawings that form a part hereof, and in which is shown by way of illustration various exemplary embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

When an air conditioner performs the cooling operation, refrigerant compressed by the compressor of the outdoor unit may be converted into a high-temperature high-pressure liquid refrigerant as it passes through the heat exchanger of the outdoor unit. When the liquid refrigerant is supplied to the at least one indoor unit, the refrigerant may be evaporated while being expanded in a heat exchanger of the indoor unit. Thus, a temperature of surrounding air may decrease due to the evaporation, and the cool air may be discharged into the indoor space while an indoor unit fan rotates.

When the air conditioner performs the heating operation, a high-temperature high-pressure gas refrigerant may be supplied from the compressor of the outdoor unit to the at least one indoor unit, and the high-temperature high-pressure gas refrigerant may be liquefied in the heat exchanger of the indoor unit. Energy emitted by the liquefaction may increase a temperature of the surrounding air, and hot air may be discharged into the indoor space while the indoor unit fan rotates.

A compressor compressing refrigerant into a high-temperature high-pressure gas state to perform a cooling or heating operation of the air conditioner may be disposed in the outdoor unit. When the compressor operates, oil together with refrigerant may be discharged from the compressor. Then, the refrigerant and the oil may be separated by an oil separator. The oil separated from the refrigerant by the oil separator may be recovered into a suction tube of the compressor through an oil recovery tube. The oil separator may be disposed outside the compressor, and the oil separated by the oil separator may be discharged again into the compressor. However, if an amount of oil discharged from the oil separator into the compressor is relatively low, an oil leakage within the compressor may cause breakdown of the compressor. Further, if an amount of oil discharged from the oil separator into the compressor is relatively high, since the oil is compressed together with the refrigerant when the compressor operates, compressor efficiency may be deteriorated.

Figure 1:
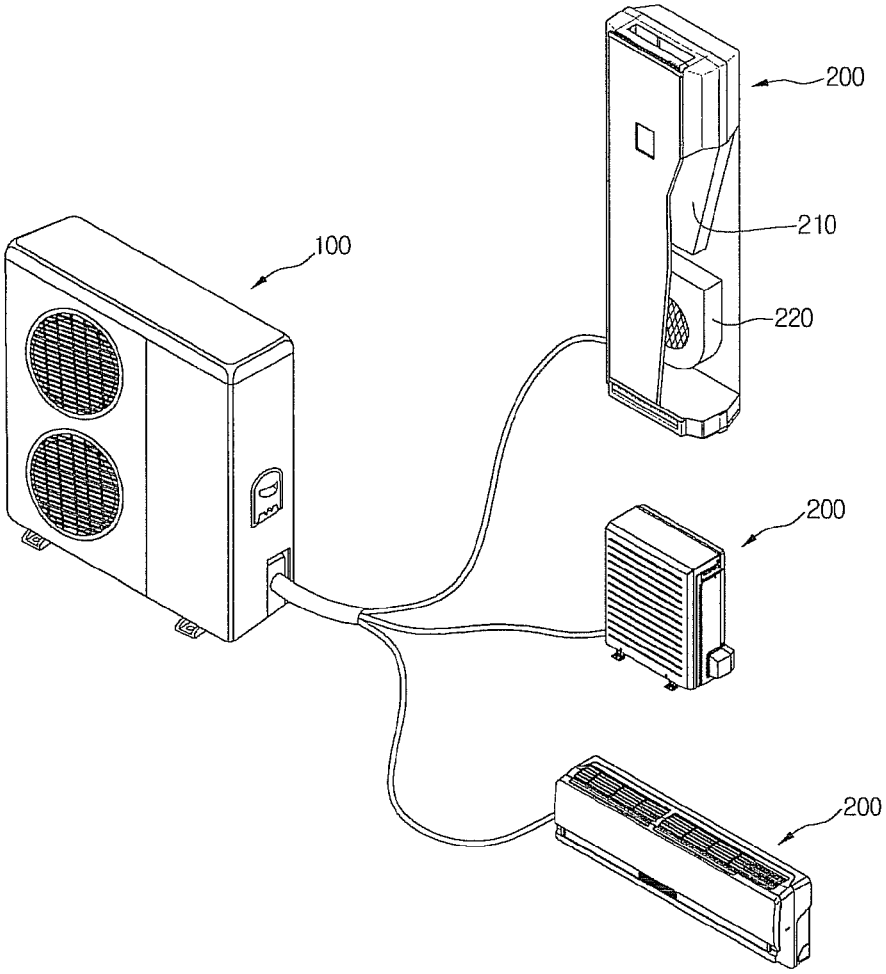
FIG. 1 is a view of an air conditioning system according to an embodiment as broadly described herein.

FIG. 1 is a view of an exemplary air conditioning system including a stand type or ceiling type air conditioner will be described, simply as an example. However, embodiments are not limited to a particular kind of air conditioner. For example, a wall mount type air conditioner, or an integrated air conditioner in which an indoor unit and an outdoor unit are not separated may also be applicable.

Referring to FIG. 1, an air conditioner may include an indoor unit 200 discharging air-conditioned air into an indoor space and an outdoor unit 100 connected to the indoor unit 200 and disposed in an outdoor space. The indoor unit 100 and the outdoor unit 200 may be connected to each other by a refrigerant tube. Thus, cold air may be discharged from the indoor unit 200 into the indoor space according to circulation of a refrigerant. In certain embodiments, a plurality of indoor units 200 may be connected to the outdoor unit 100.

The air conditioner includes a plurality of indoor units 200 and at least one outdoor unit 100 connected to the plurality of indoor units 200. The plurality of indoor units 200 and the outdoor unit 100 may be connected to each other by a refrigerant tube. The plurality of indoor units 200 and the outdoor unit 100 may also be connected to each other by a communicable cable to transmit and receive a control command according to a predetermined communication method.

The air conditioner may further include a remote controller controlling the plurality of indoor units 200 and the outdoor unit 100, and/or a local controller connected to the indoor units 200 to receive a user input and output an operation state of each of the indoor units 200. The air conditioner may further include a ventilator, an air cleaner, a humidifier, a dehumidifier, a heater and the like, in addition to the indoor units 200 and the outdoor unit 100. The remote controller may be connected to a lighting device and an alarm so that the remote controller, the lighting device, and the alarm may be mutually operable.

The indoor unit 200 may include a discharge hole through which heat-exchanged air is discharged. A wind direction adjustment device that opens and closes the discharge hole and controls a direction of the discharged air may be disposed in the discharge hole. The indoor unit 200 may also adjust a volume of the air discharged from the discharge hole. Here, a plurality of vanes may be disposed in a plurality of air suction holes and a plurality of air discharge holes. The vanes may open or close at least one of the plurality of air suction holes and the plurality of air discharge holes and also guide an air flow direction.

The indoor unit 200 may further include a display device displaying an operation state and set information of the indoor unit 200 and an input device receiving set data. When a user inputs an operation command of the air conditioner through the input device, the outdoor unit 100 may operate in a cooling or heating mode corresponding to the received command. The outdoor unit 100 may supply refrigerant to the plurality of indoor units 100. Then, the air flow direction may be guided along the discharge hole of the indoor unit 100 to adjust an indoor environment.

Hereinafter, internal systems of the indoor unit 200 and the outdoor unit 100 of the air conditioner will be described with respect to FIG. 2.

Figure 2:
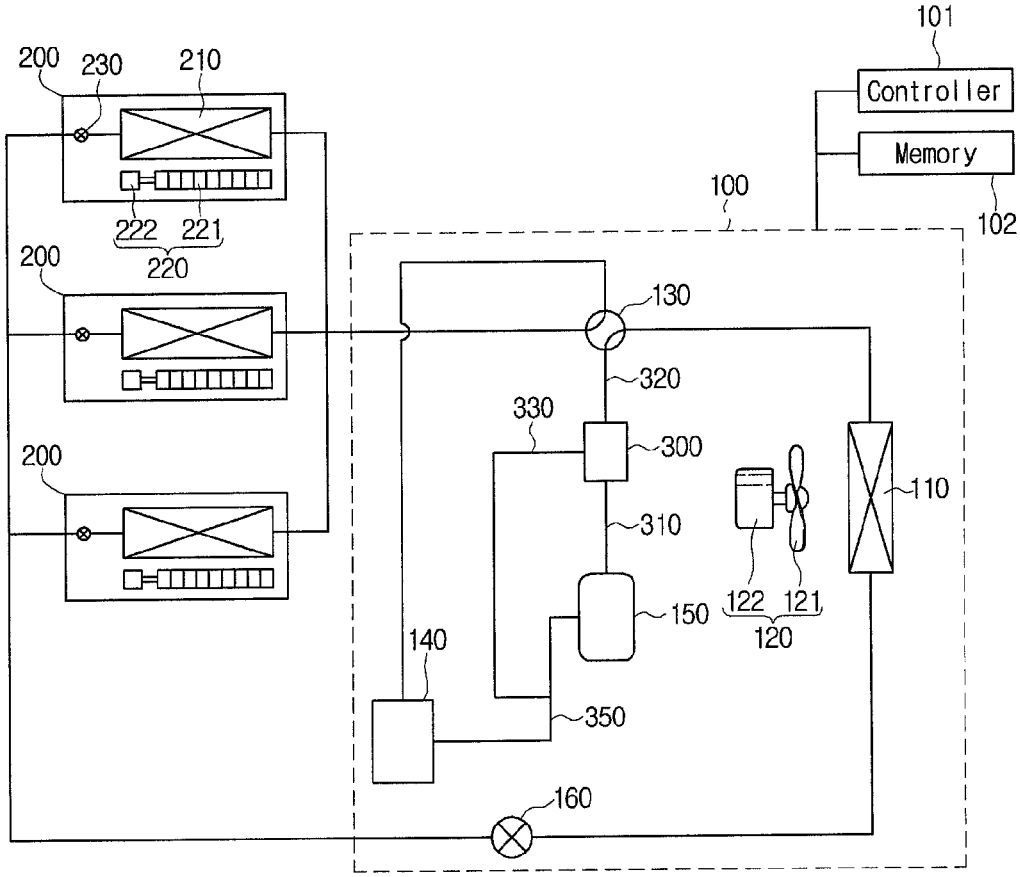
FIG. 2 is a schematic view of the air conditioner shown in FIG. 1.

Referring to FIG. 2, the outdoor unit 100 may include an outdoor heat exchanger 110 in which outdoor air and refrigerant undergo heat-exchange, an outdoor air blower 120 blowing outdoor air into the outdoor heat exchanger 110, an accumulator 140 extracting a gas refrigerant, a compressor 150 compressing the gas refrigerant extracted by the accumulator 140, a four-way valve 130 switching a refrigerant flow, and an outdoor electronic expansion valve 160 controlled according to overcooling and overheating when the heating operation is performed.

When the air conditioner performs a cooling operation, the outdoor heat exchanger 110 may serve as a condenser in which a gas refrigerant transferred into the outdoor heat exchanger 110 is condensed. When the air conditioner performs a heating operation, the outdoor heat exchanger 110 may serve as an evaporator in which a liquid refrigerant transferred into the outdoor heat exchanger 110 is evaporated.

The outdoor air blower 120 may include an outdoor motor 122 generating power and an outdoor fan 121 connected to the outdoor motor 122 to generate a blowing force under the power of the outdoor motor 122.

In certain embodiments, the outdoor unit 100 may include two compressors therein. One of the two compressors may be an inverter, and the other one may be a constant speed compressor. However, embodiments are not limited in number and/or kind of compressor.

In certain embodiments, the outdoor unit 100 may be provided in plurality. Particularly, the outdoor unit 100 may include a main outdoor unit and an auxiliary outdoor unit. The main outdoor unit and the auxiliary outdoor unit may be connected to the plurality of indoor units 200. The main outdoor unit and the auxiliary outdoor unit may operate based on requirement of at least one of the plurality of indoor units 200. First, the main outdoor unit may operate to correspond to the number of operating indoor units. Then, when a cooling or heating capacity varies to exceed an allowable capacity of the main outdoor unit, the auxiliary outdoor unit may operate. That is, the number of operating outdoor units and an operation of the compressor provided in the outdoor unit may vary to correspond to a required cooling or heating capacity.

Each indoor unit 200 may include an indoor heat exchanger 210 in which indoor air and refrigerant undergo heat-exchange, an indoor air blower 220 blowing the indoor air into the indoor heat exchanger 210, and an indoor electronic expansion valve 230 that adjusts flow rate according to a degree of overcooling or overheating.

When the air conditioner performs the cooling operation, the indoor heat exchanger 210 may serve as an evaporator in which a liquid refrigerant transferred into the indoor heat exchanger 210 is evaporated by the indoor air. When the air conditioner performs the heating operation, the indoor heat exchanger 210 may serve as a condenser in which a gas refrigerant transferred into the indoor heat exchanger 210 is condensed by the indoor air.

The indoor air blower 220 may include an indoor motor 222 generating power and an indoor fan 221 connected to the indoor motor 222 to generate a blowing force under the power of the indoor motor 222. In certain embodiments, the air conditioner may be configured as a cooler cooling the indoor space. In other embodiments, the air conditioner may be configured as a heat pump cooling or heating the indoor space.

As described above, the air conditioner may include a space in which the refrigerant moves to perform the cooling or heating operation. Particularly, a plurality of components may be disposed in the outdoor unit 100 and the indoor unit 200 of the air conditioner. The plurality of components may include a refrigerant tube that defines a passage through which the refrigerant flows. The refrigerant to be heat-exchanged with external air flows into the refrigerant tube.

When the air conditioner performs the cooling or heating operation, a refrigerant compressed into a high-temperature high-pressure gas state by the compressor 150 may be introduced into an oil separator 300 along a suction tube 310 together with the oil discharged from the compressor 150. The oil separator 300 separates the refrigerant and the oil which are introduced therein and then discharges the separated refrigerant into a discharge tube 320. The oil separated by the oil separator 300 may flow along an oil recovery tube 330. The oil recovery tube 330 may communicate with a guide tube 350 guiding refrigerant into the compressor 150. Thus, the oil flowing along the oil recovery tube 330 may be mixed with the refrigerant passing through the guide tube 350 and then be introduced into the compressor 150.

However, if an amount of oil introduced into the compressor 150 is too much, or not enough, performance the compressor 150 may be deteriorated. Thus, it may be necessary to control an amount of oil introduced into the compressor 150 through the oil recovery tube 330.

Figure 3:
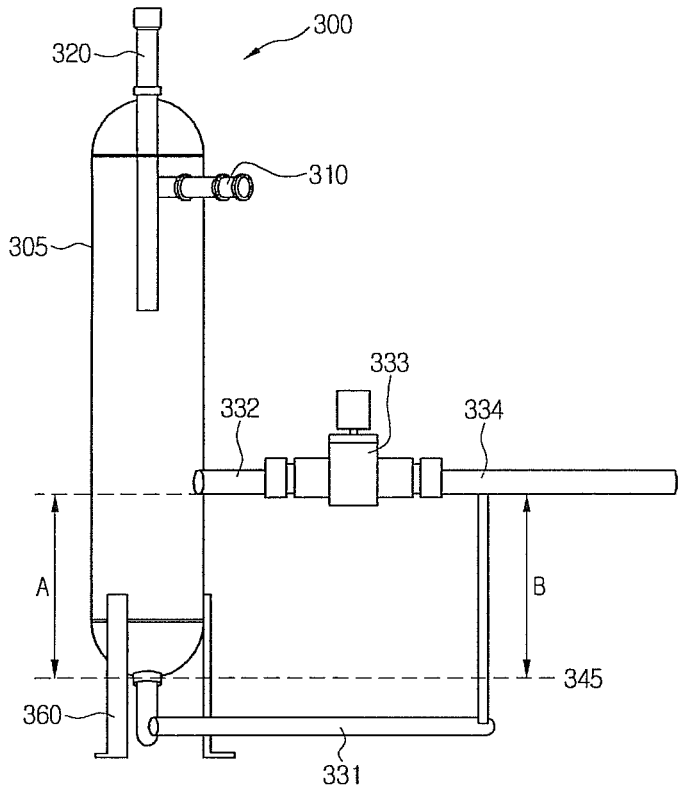
FIG. 3 illustrates an oil separator and oil recovery tubes of an air conditioner, according to an embodiment as broadly described herein.

FIG. 3 is a view of a state in which an oil separator and an oil recovery tube are connected to each other in an air conditioner, according to an embodiment as broadly described herein.

Referring to FIG. 3, the oil separator 300 may include a housing 305 defining an outer appearance thereof, a suction tube 310 communicating with the housing 305 to provide a path through which the refrigerant and oil discharged from the compressor 150 may be introduced, a discharge tube 320 to guide refrigerant for discharge to the outside, and an oil recovery tube 330 providing a path through which the oil introduced through the suction tube 310 is discharged again into the compressor.

The oil separator 310 may further include a support 360 disposed on a bottom surface of the housing 305 to support a load of the housing 305.

The oil recovery tube 330 may include a first recovery tube 331 communicating with the bottom surface of the housing 305 to provide a flow path for the oil and a second recovery tube 332 communicating with a side surface of the housing 305, at an intermediate portion of the housing 305, to provide a flow path for the oil. That is, the oil discharged from the compressor 150 into the oil separator 300 may be discharged again into the compressor 150 through the first and second recovery tubes 331 and 332.

The first and second recovery tubes 331 and 332 may communicate with each other. A combining tube 334 may be disposed at a position at which the first and second recovery tubes 331 and 332 communicate with each other. That is, the oil passing through the first recovery tube 331 and the oil passing through the second recovery tube 332 may be mixed with each other in the combining tube 334.

If the bottom surface of the housing 305 is considered a reference surface 345, a distance B between the reference surface 345 and the combining tube 334 may be greater than or equal to a distance A between the second recovery tube 332 and an inlet into the first recovery tube 331. This may prevent the oil flowing through the second recovery tube 332 from flowing backward.

A flow of the refrigerant and oil passing through the oil separator 300 will be described below.

First, refrigerant and oil in a high-temperature high-pressure gas state may be contained in a material passing through the compressor 150. The gas refrigerant and oil passing through the compressor 150 may be referred to as an oil-mixed refrigerant. The oil-mixed refrigerant passing through the compressor 150 may be introduced into the oil separator 300 through the suction tube 310. The oil separator 300 separates the gas refrigerant and oil.

The refrigerant separated by the oil separator 300 may be discharged into a condenser through the discharge tube 320. The oil separated by the oil separator may be discharged again to the compressor through the oil recovery tube 330 including the first recovery tube 331 disposed on the bottom surface of the housing 305 and the second recovery tube 332 disposed on a side surface of the housing 305. Thus, the oil separated by the oil separator 300 may be discharged to the compressor 150 through the first or second recovery tube 331 or 332.

Particularly, the oil separated by the oil separator 300 may be discharged into the compressor 150 through one of the first or second recovery tubes 331 and 332. An oil valve 333 guiding an oil flow direction may be disposed in the second recovery tube 332.

When the oil valve 333 is opened, since a suction pressure within the second recovery tube 332 is greater than that within the first recovery tube 331, due at least in part to their relative positions, the oil may flow only into the second recovery tube 332. On the other hand, when the oil valve 333 is closed, since a suction pressure within the second recovery tube 332 is less than that within the first recovery tube 331, the oil may flow only into the first recovery tube 331. That is, a path through which the oil flows from the oil separator 300 into the compressor 150 may be changed according to the opening or closing of the oil valve 333. Thus, if a level of the oil received in the housing 305 is defined, the second recovery tube 332 may operate until the defined level of the oil level is less than or equal to that of oil received in the housing 305.

Figure 4:
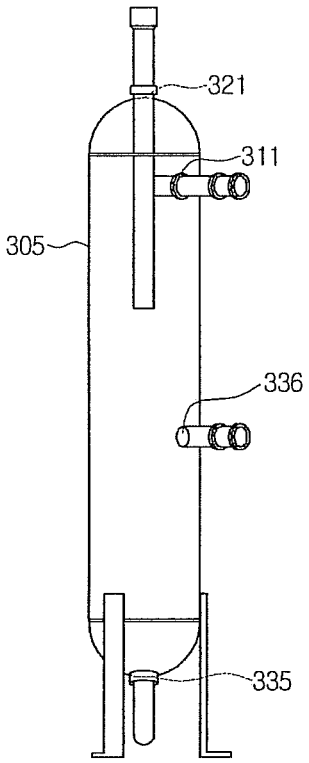
FIG. 4 is a view of a plurality of holes formed in the oil separator shown in FIG. 3, according to an embodiment as broadly described herein.

Referring to FIG. 4, the oil separator 300 may include, a plurality of holes defined in the housing 305 to be connected to the plurality of tubes. First, an oil suction hole 311 suctioning the gas refrigerant and oil discharged from the compressor 150 may be defined in the housing 305. The gas refrigerant and oil may pass through the suction tube 310 and then be introduced into the housing 305 through the oil suction hole 311 defined in a side of the housing 305. The gas refrigerant introduced into the housing 305 may be discharged to the outside through a discharge hole defined in an upper portion of the housing 305. Particularly, the gas refrigerant may be guided by the discharge tube 320 along the discharge hole 321 to flow into the condenser. Also, the oil introduced into the housing 305 may be discharged again to the compressor 150 through a first or second through hole 335 or 336. The second through hole 336 may communicate with the second recovery tube 332, and the first through hole 335 may communicate with the first recovery tube 331. The first through hole 335 may be disposed in the bottom surface of the housing 305, and the second through hole 336 may be defined in the side surface of the housing 305. However, with respect to the housing 305, the positions of the first and second through holes 335 and 336 are not limited to the above-described positions.

Figure 5A:
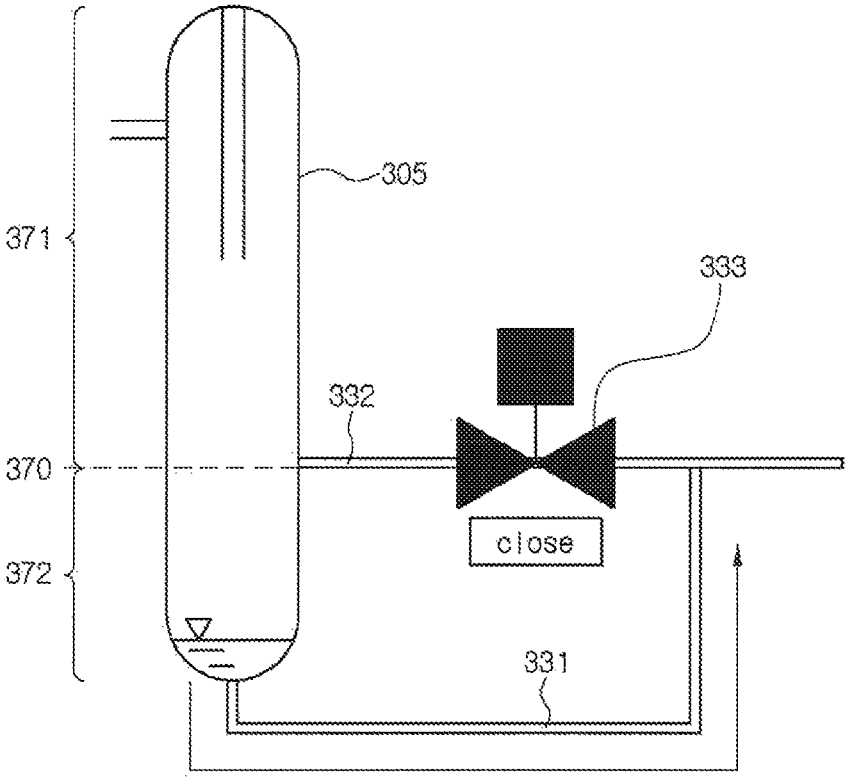
FIGS. 5A and 5B illustrate a flow direction of oil passing through an oil recovery tube based on a position of an oil valve in an air conditioner according to an embodiment as broadly described herein.
Figure 5B:
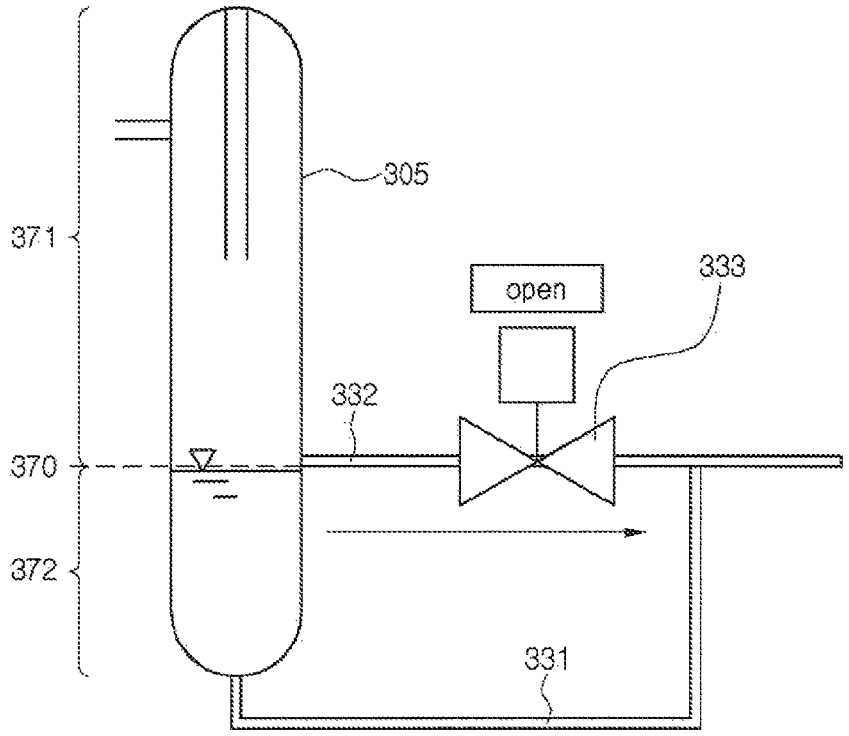

FIGS. 5A and 5B illustrate a flow direction of oil passing through the oil recovery tube depending on opening or closing of an oil valve according to an embodiment.

Referring to FIG. 5, a flow direction of oil in the oil separator 300 may be changed according to an amount of oil received in the oil separator 300. That is, when the oil is recovered from the oil separator 300 toward the compressor 150, the oil may flow along the first or second recovery tube 331 or 332. The oil valve 333 may be disposed in the second recovery tube 332. Thus, the oil may flow into one of the first or second recovery tubes 331 and 332 according to the opening or closing of the oil valve 333.

A virtual surface defined to extend from the second recovery tube 332 across, or in a lateral direction of, the housing 305 may be referred to as an extension surface 370. A portion above the extension surface 370 corresponding to an upper portion of the housing 305 may be referred to as an upper extension part 371, and a portion below the extension surface 370 corresponding to a lower portion of the housing 305 may be referred to as a lower extension part 372.

When the oil valve 333 disposed in the second recovery tube 332 is opened, the oil accommodated within the housing 305 may flow into the compressor 150 through the second recovery tube 332. Since a suction pressure of the oil within the first recovery tube 331 is less than that of the oil within the second recovery tube 332 as the oil valve 333 is opened, the oil may flow through only the second recovery tube 332.

Thus, only the oil in the upper extension part 371 of the housing 305 may flow. That is, the oil accommodated in the lower extension part 372 may remain stored in the housing 305, and only the oil accommodated in the upper extension part 371 may flow into the compressor 150 through the second recovery tube 232.

On the other hand, when the oil valve 333 is closed, the oil accommodated within the housing 305 may flow into the compressor 150 through only the first recovery tube 331. Thus, when the oil valve 333 is closed, the oil stored in the upper extension part 371 of the housing 305 and the oil stored in the lower extension part 372 of the housing 305 may flow into the compressor 150 through the first recovery tube 331.

Thus, if an amount of oil required by the system is relatively high, the oil valve 333 may be closed so that the oil accommodated in the upper and lower extension parts 371 and 372 flows into the compressor 150 along the first recovery tube 331. On the other hand, if an amount of oil required by the system is relatively low, the oil valve 333 may be opened so that only the oil accommodated in the upper extension part 371 flows into the compressor 150 along the second recovery tube 332.

However, embodiments are not limited to this installation position of the oil valve 333. That is, the oil valve 333 may be disposed in the first recovery tube 331.

The air conditioner according to the current embodiment may also include a memory 102 in which information with respect to an amount of oil required for the system is mapped, and a controller 101 controlling opening or closing of the oil valve according to the amount of oil required for the system. Particularly, the controller 101 may compare the information with respect to the amount of oil required for the system that is previously stored in the memory 102 to the amount of oil currently stored in the oil separator 300 to control the opening or closing of the oil valve 333.

Figure 6:
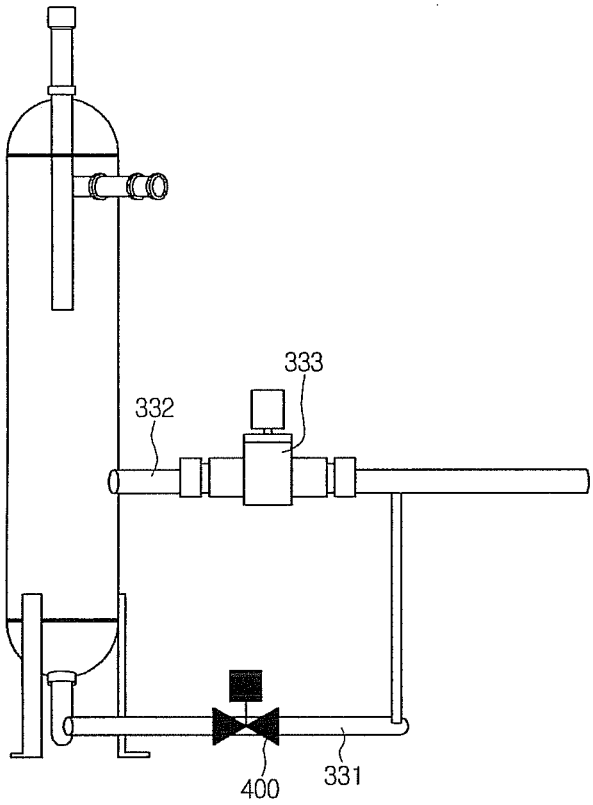
FIG. 6 illustrates an adjustment valve disposed on a side of the oil recovery tube shown in FIGS. 5A and 5B.

FIG. 6 is a view of an adjustment valve disposed on a side of an oil recovery tube of an air conditioner, according to an embodiment as broadly described herein.

Referring to FIG. 6, the oil introduced into the oil separator 300 may be guided toward the compressor 150 through one of the first or second recovery tubes 331 or 332. The oil valve 333 may be disposed in the second recovery tube 332. Also, an adjustment valve 400 adjusting an amount of oil introduced into the compressor 150 according to an amount of oil required for the system may be disposed in the first recovery tube 331.

The adjustment valve 400 may control a flow of oil introduced through the first recovery tube 331. Thus, a user may control the adjustment valve 400 to precisely adjust an amount of oil introduced into the compressor 150. However, embodiments are not limited to the positions of the adjustment valve 400 and the oil valve 333. That is, the adjustment valve 400 may be disposed in the second recovery tube 332, and the oil valve 333 may be disposed in the first recovery tube 331.

Embodiments provide an oil separator and an air conditioner using the same in which an amount of oil discharged from an oil separator into a compressor may be adequately controlled to smoothly operate the compressor.

In one embodiment, an oil separator as embodied and broadly described herein may include a housing defining an outer appearance, a suction tube guiding introduction of an oil-mixed refrigerant into the housing, a discharge tube discharging a refrigerant separated from the oil-mixed refrigerant suctioned through the suction tube, and an oil recovery tube including first and second recovery tubes discharging oil separated from the oil-mixed refrigerant, wherein at least one of the first and second recovery tubes includes an oil valve guiding movement of the oil.

In another embodiment, an air conditioner as broadly described herein may include an indoor unit air-conditioning indoor air, and an outdoor unit connected to the indoor unit through a refrigerant tube, wherein the outdoor unit may include a compressor compressing a refrigerant, and an oil separator including a plurality of oil recovery tubes introducing oil into the compressor, wherein at least one of the plurality of oil recovery tubes includes an oil valve guiding a movement direction of the oil.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oil separator, comprising:

a housing including a bottom;

a suction tube that is provided at an outer circumferential portion of the housing and guides an oil-mixed refrigerant into the housing;

a discharge tube that is provided at the housing and discharges refrigerant separated from the oil-mixed refrigerant introduced into the housing through the suction tube;

a first recovery tube provided at the housing to discharge oil separated from the oil-mixed refrigerant, the first recovery tube including:

a first vertical portion having a first inlet coupled at the bottom of the housing, the first vertical portion extending from the first inlet downward;

a horizontal portion horizontally extending from the first vertical portion; and a second vertical portion extending from the horizontal portion upward, a second recovery tube having a second inlet coupled at an intermediate portion of the housing to discharge oil separated from the oil-mixed refrigerant, the second recovery tube extending from the second inlet horizontally;

a combination tube including a combination portion connecting the second recovery tube with the second vertical portion of the first recovery tube and extending horizontally, a vertical height of the combination tube being approximately equal to a vertical height of the second inlet of the second recovery tube with respect to the bottom of the housing; and an oil valve provided in the second recovery tube, between the housing and the combination portion of the combination tube, to guide movement of the oil through the first and second recovery tubes, wherein when a level of the oil received in the housing is greater than or equal to a height of the second recovery tube, the oil valve is opened such that the oil in the housing flows towards the combination tube through the second recovery tube, and wherein when the level of the oil received in the housing is less than height of the second recovery tube, the oil valve is closed such that the oil in the housing flow towards the combination tube through the first vertical portion, the horizontal portion, and the second vertical portion.

2. The oil separator according to claim 1, wherein the housing is partitioned into an upper extension portion and a lower extension portion by a virtual surface that extends across the housing at a plane corresponding to the second recovery tube.

3. The oil separator according to claim 2, wherein oil received in the upper extension portion is suctioned into the second recovery tube when the oil valve is opened, and oil received in the upper extension portion and the lower extension portion is suctioned into the first recovery tube when the oil valve is closed.

4. The oil separator according to claim 1, further including a flow adjustment valve provided in the first recovery tube to control a flow direction and an amount of oil flowing therethrough.

5. An air conditioner including the oil separator of claim 1.

* * * * *